US005870958A

United States Patent [19]

Suzuki

[11] Patent Number: 5,870,958

[45] Date of Patent: Feb. 16, 1999

[54] DUPLEX PALLET

[75] Inventor: Kiyoshi Suzuki, Tokyo, Japan

[73] Assignee: NEC Corporation, Japan

[21] Appl. No.: 52,527

[22] Filed: Mar. 31, 1998

[30] Foreign Application Priority Data

Apr. 1, 1997 [JP] Japan ..... 9-082671

[51] Int. Cl.[6] ..... B65D 19/38

[52] U.S. Cl. ..... 108/54.1; 108/51.1

[58] Field of Search ..... 108/51.11, 54.1, 108/56.1; 206/386

[56] References Cited

U.S. PATENT DOCUMENTS 5,706,738 1/1998 Rapeli ..... 108/54.1

FOREIGN PATENT DOCUMENTS 60-148451 8/1985 Japan .
5-82829 11/1993 Japan .
6-72840 10/1994 Japan .
7-149346 6/1995 Japan .
7-187186 7/1995 Japan .
8-91375 4/1996 Japan .
8-217071 8/1996 Japan .
8-509684 10/1996 Japan .

*Primary Examiner*—Peter M. Cuomo
*Assistant Examiner*—Gerald A. Anderson
*Attorney, Agent, or Firm*—Ostrolenk, Faber, Gerb & Soffen, LLP

[57] ABSTRACT

A duplex pallet for the transport or storage of articles of the present invention has a deck surface easily switchable between a configuration matching with, e.g., the ISO (International Standards Organization) standards and a configuration matching with, e.g., JIS (Japanese Industrial Standards). While the deck surface is held in the configuration matching with the ISO standards, a hook and a contact guide are respectively released from a clamp post and a pallet body so as to release one longer edge of a movable deck from one shorter edge of the pallet body. Subsequently, the movable deck is rotated away from the pallet body by 90 degrees, then shifted inward, and then further rotated in the same direction by 180 degrees until the hook mates with another clamp post. At the same time, another contact guide is inserted into a space between an upper deck and a lower deck. In this condition, one longer edge of the pallet body and the other longer edge of the movable deck contact each other, implementing the configuration matching with JIS.

14 Claims, 7 Drawing Sheets

DUPLEX PALLET

BACKGROUND OF THE INVENTION

The present invention relates to a duplex pallet for the transport, storage or the like of articles and, more particularly, to a duplex pallet generally made up of a pallet body or first deck and a movable deck or second deck connected to the pallet body.

Pallets made of wood are extensively used for the transport of packed articles. After a pallet has been loaded with packaged articles, it is transported by a forklift or similar vehicle together with the articles to a container or a truck for transport or to a warehouse for storage. The problem with such a pallet is that to promote efficient transport of articles each having a particular size, various kinds of pallets each having a deck surface of particular size or configuration must be prepared. Selecting a pallet of optimal size for each kind of article is extremely troublesome.

In light of the above, a pallet with a deck surface which is variable in configuration is proposed in, e.g., Japanese Patent Laid-Open Publication No. 8-217071 and Japanese Utility Model Laid-Open Publication No. 5-82829. However, the pallet taught in Laid-Open Publication No. 8-217071 is fastened by a plurality of bolts and nuts, resulting in time- and labor-consuming fastening work. In addition, inspections and maintenance are necessary for regulating the dimensions of a plurality of pallets within a standard range. Although the pallet disclosed in Laid-Open Publication No. 5-82829 is variable in contour, various kinds of pallets each matching with the dimensions of a particular article and adjusted in dimension must be prepared and selectively used. This is also time- and labor-consuming. Moreover, the pallet is variable in horizontal length, but not variable in vertical length.

Technologies relating to the present invention are also taught in, e.g., Japanese Patent Laid-Open Publication No.s 8-91375, 7-187186, 7-149346 and 60-148451, Japanese Utility Model Laid-Open Publication No. 6-72840, and Japanese Patent Kohyo No. 8-509684.

SUMMARY OF THE INVENTION

It is therefore an object of the present invention to provide a duplex pallet having a deck surface variable in configuration, as needed, and therefore easy and convenient to use.

In accordance with the present invention, a duplex pallet includes a first deck having any desired configuration for loading an article in order to allow the article to be conveniently handled. A second deck has any desired configuration and is rotatably connected to the first deck for allowing the first deck to be extended. A switching mechanism allows the second deck to be rotated relative to the first deck by a preselected angle between a first extended position where a first side edge of the second deck and a first side edge of the first deck contact and a second extended position where a second side edge of the second deck and a second side edge of the first deck contact.

Also, in accordance with the present invention, a duplex pallet includes a substantially square first deck, a substantially square second deck rotatably connected to the first deck for allowing the first deck to be extended, and a switching mechanism. The switching mechanism allows the second deck to be rotated by 270 degrees about a preselected corner of the first deck between a first extended position where a first side of the second deck and a first side of the first deck contact and a second extended position where a second side of the second deck facing the first side and a second side of the first deck perpendicular to the first side contact.

BRIEF DESCRIPTION OF THE DRAWINGS

The above and other objects, features and advantages of the present invention will become apparent from the following detailed description taken with the accompanying drawing in which.

DESCRIPTION OF THE PREFERRED EMBODIMENT

To better understand the present invention, brief reference will be made to conventional duplex pallets.

Figure 1A:
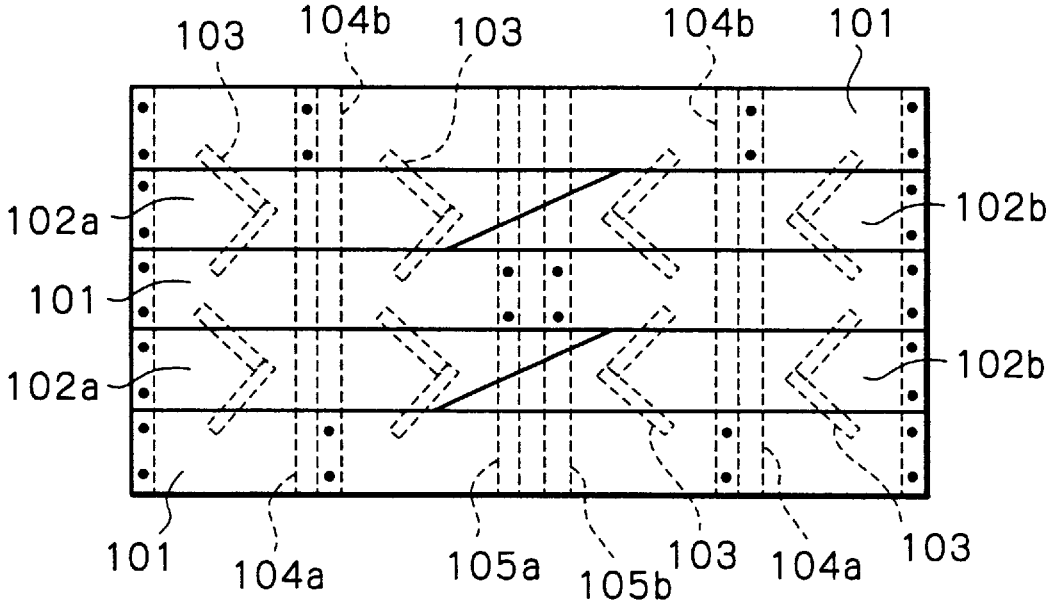
Fig. 1A PRIOR ART
FIGS. 1A and 1B are plan views showing a conventional pallet.
Figure 1B:
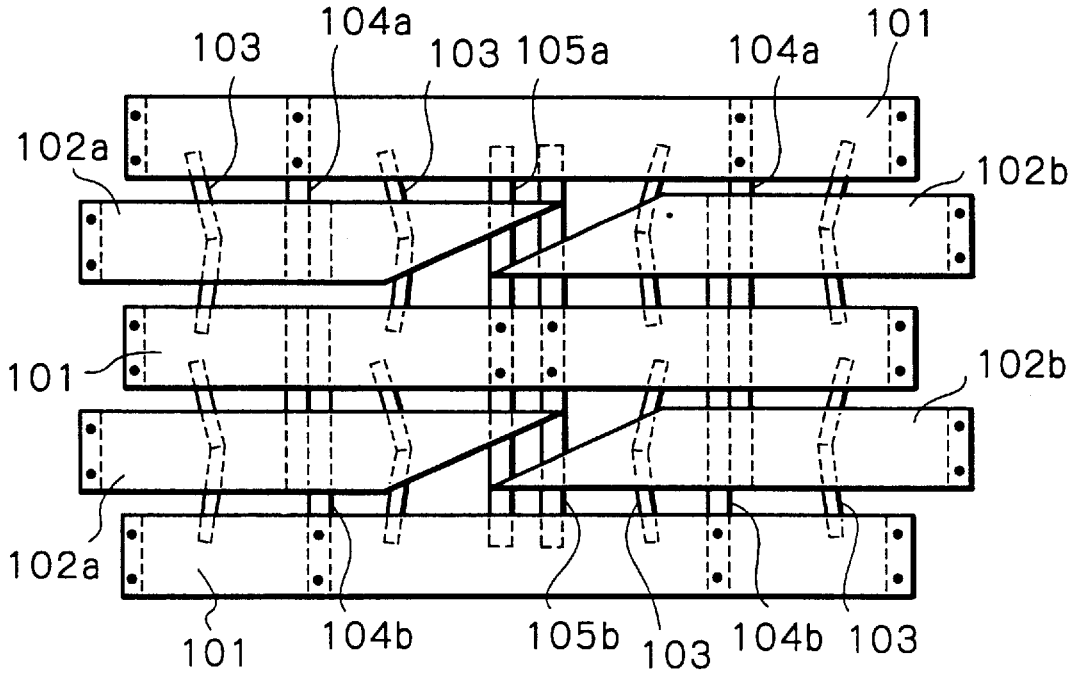
Fig. 1B PRIOR ART

FIGS. 1A and 1B show a duplex pallet taught in Laid-Open Publication No. 8-217071 mentioned earlier. As shown in FIG. 1A, the pallet includes plates 101 and divided plates 102*a* and 102*b* each being cut obliquely into two parts. Each divided plate 102*a* or 102*b* intervenes between nearby plates 101. Each divided plate 102*a* or 102*b* and the plates 101 adjoining it are interconnected by link mechanisms 103 arranged on the rear surfaces of the plates. In this configuration, the plates 101 and divided plates 102*a* and 102*b* are movable vertically and horizontally in order to set up a deck surface having a desired contour.

Two pairs of crossbars 104*a* and 104*b* are also arranged on the rears of the plates 101 and divided plates 102*a* and 102*b*. The crossbars 104*a* and 104*b* of each pair are positioned side by side and slidable on each other. One end of the crossbar 104*a* and one end of the cross bar 104*b* opposite to the one end of the crossbar 104*a* are respectively affixed to the opposite outermost plates 101 in a cantilever fashion. Crossbars 105*a* and 105*b* are also affixed to the plates 101. As shown in FIG. 1B, the outermost plates 101 are movable away from each other in the widthwise direction so as to expand or contract the pallet to a desired size. Subsequently, the cross bars 104*a*, 104*b*, 105*a* and 105*b* are fastened to the plates 101 by bolts and nuts.

The problem with the above pallet is that the bolt and nut fastening scheme is time- and labor-consuming and needs inspections and maintenance for regulating the dimensions of a plurality of pallets within a standard range as stated earlier.

Figure 2:
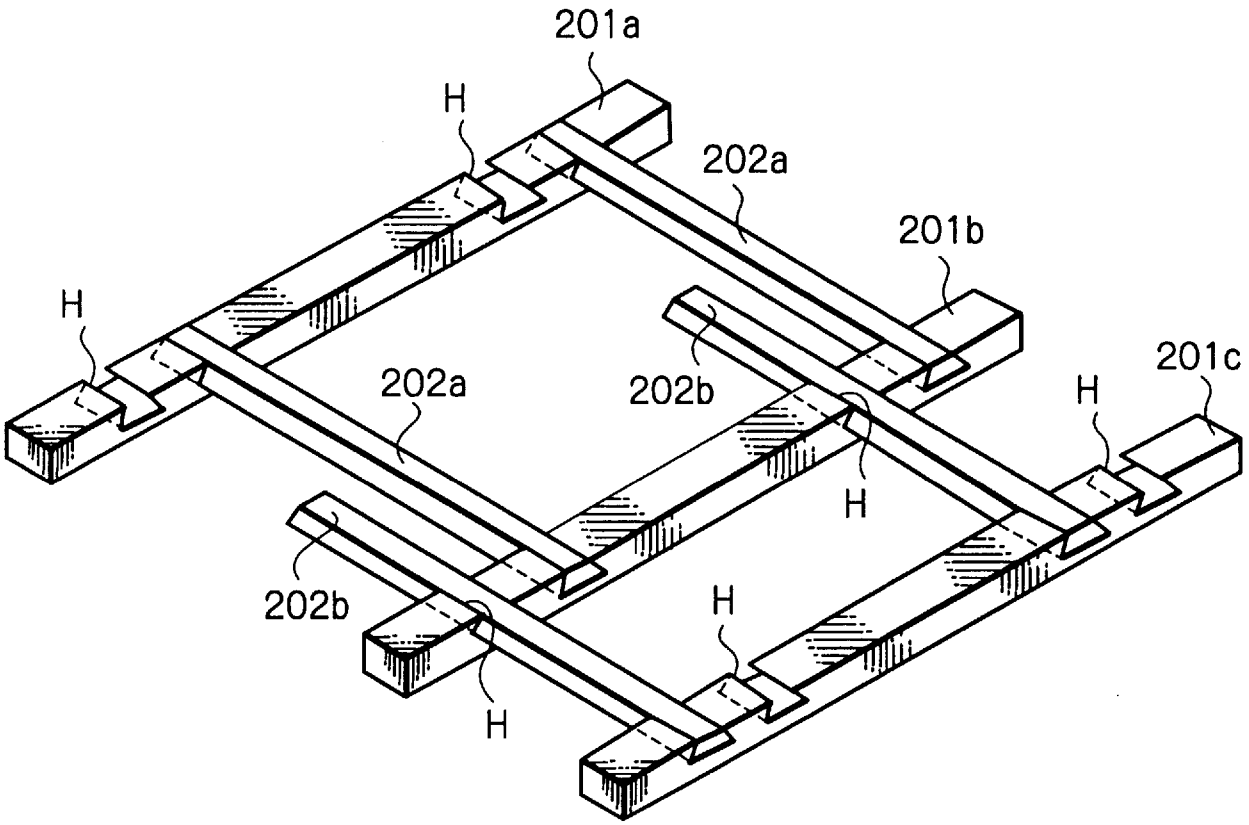
Fig. 2 PRIOR ART
FIG. 2, is a perspective view showing another conventional pallet.

FIG. 2 shows another conventional pallet taught in Laid-Open Publication No. 5-82829 also mentioned earlier. As shown, the pallet includes three substantially parallel bars 201*a*, 201*b* and 201*c*. Substantially parallel crossbars 202*a* and 202*b* extend perpendicularly to the bars 201*a*–201*c*, and each bridges nearby bars 201*a* and 201*b* or 201*b* and 201*c*. The bars 201*a*–201*c* each is formed with recesses H for receiving the crossbar 202*a* or 202*b*. The recesses H are therefore complementary in cross-section to the crossbars 202*a* and 202*b*. The upper surfaces of the bars 201*a*–201*c* and those of the cross bars 202*a* and 202*b* are substantially flush with each other. Each recess H is flared toward its bottom, as viewed in a section, in order to prevent the crossbar 202*a* or 202*b* from slipping out of the recess H. To change the contour of the pallet, the bars 201*a* and 201*b*, for example, are fixed in place while the bar 201*c* is moved together with the crossbars 202*b* in order to change the distance between the bars 201*c* and 201*b*.

While the pallet shown in FIG. 2 is variable in contour, various kinds of pallets each matching with the dimensions of a particular article and adjusted in dimension must be prepared and selectively used. This is also time- and labor-consuming. In addition, the dimension of the pallet in the direction parallel to the bars 201*a*–201*c* cannot be changed.

Figure 3:
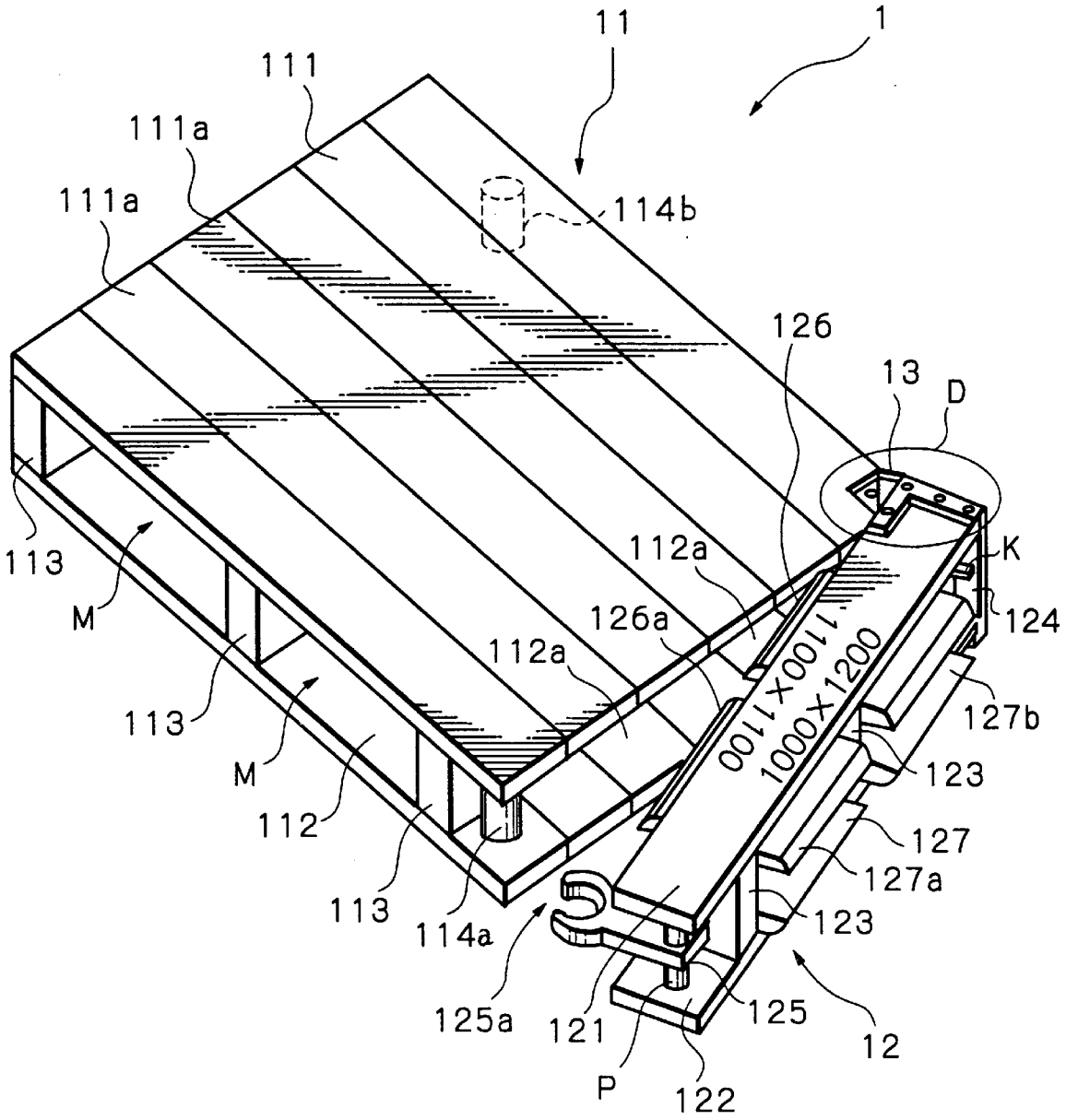
FIG. 3 is a perspective view showing a duplex pallet embodying the present invention.
Figure 4:
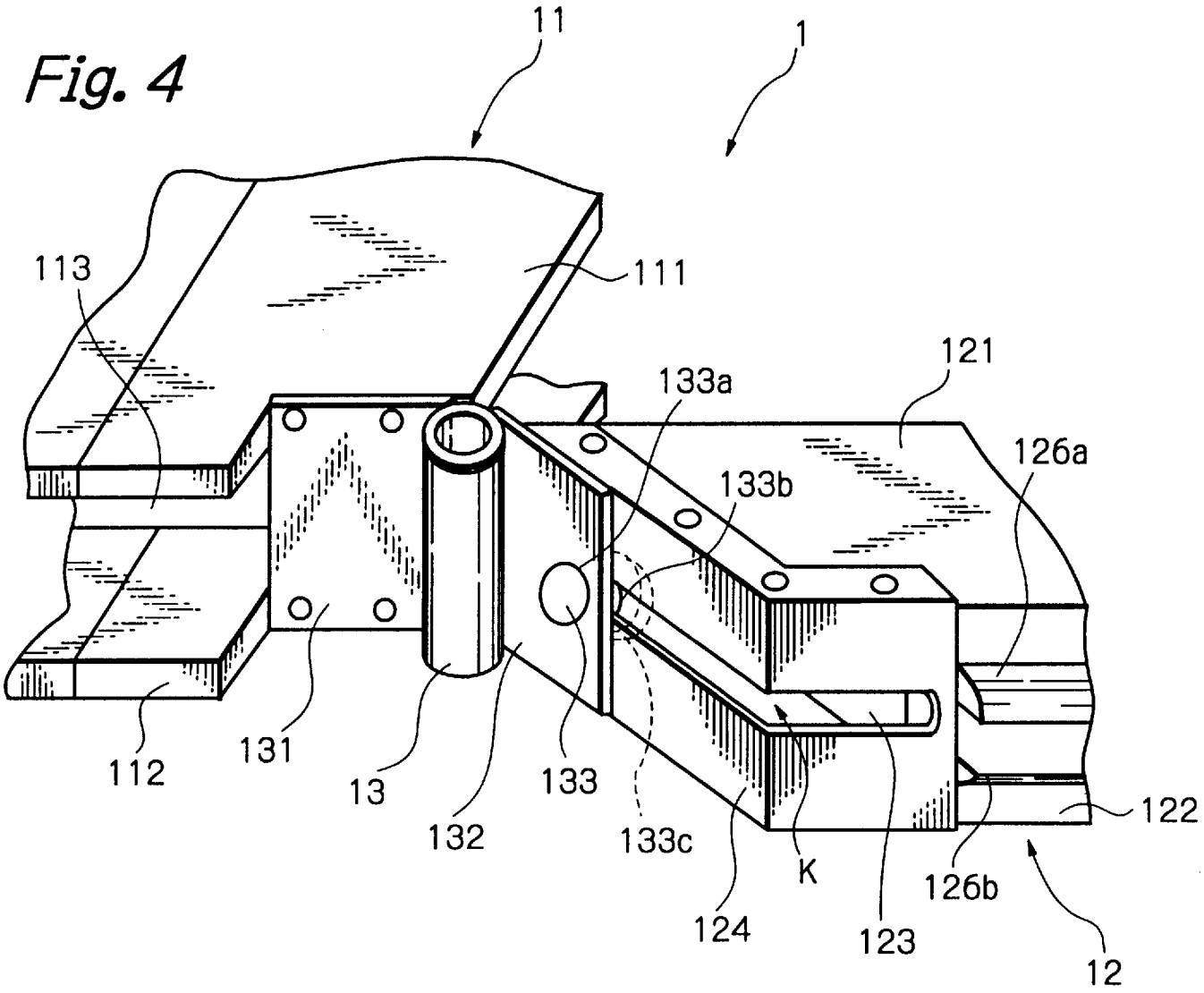
FIG. 4 is fragmentary enlarged perspective view showing the illustrative embodiment.

Referring to FIGS. 3–6, a duplex pallet embodying the present invention will be described. FIG. 4 is an enlarged view of a part D of the duplex pallet shown in FIG. 3. As shown, the duplex pallet, generally 1, is generally made up of a pallet body 11 and a movable deck 12. The pallet body 11 has an oblong 1,100 mm×1,000 mm size, as seen in a plan view. The movable deck 12 is hinged to the pallet body 11 and has an oblong 1,000 mm×100 mm size. The pallet 1 may be used when, e.g., a forklift transports industrial products produced in a factory and packed.

Figure 5A:
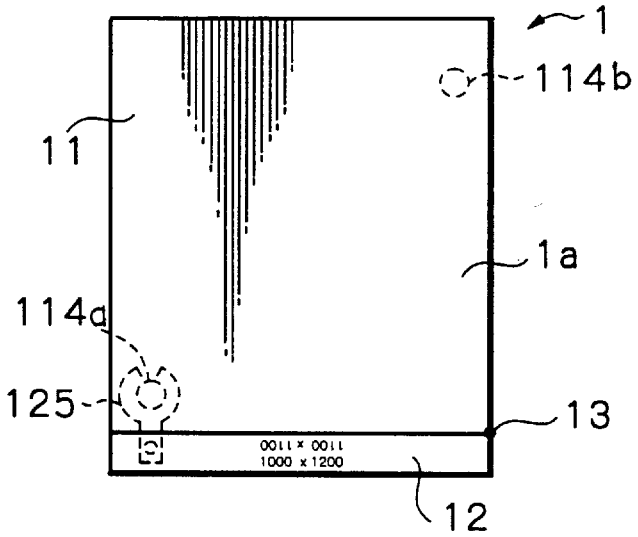
FIGS. 5A–5D are plan views demonstrating the operation of the illustrative embodiment.
Figure 5B:
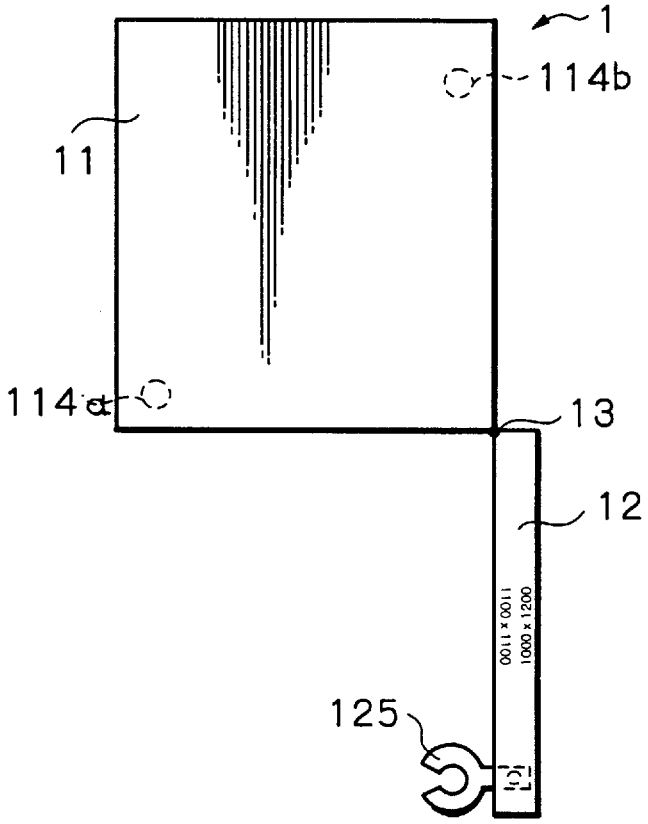
Figure 5C:
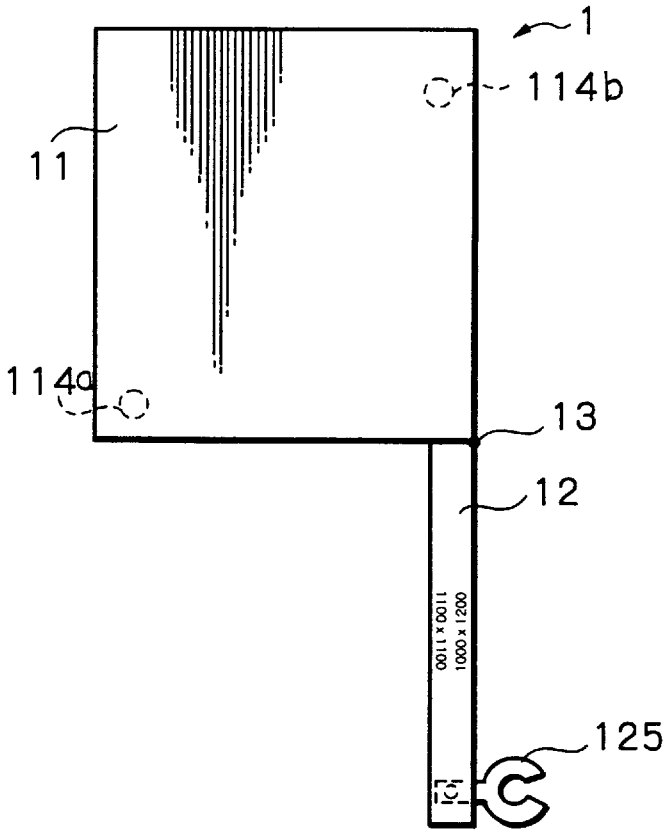
Figure 5D:
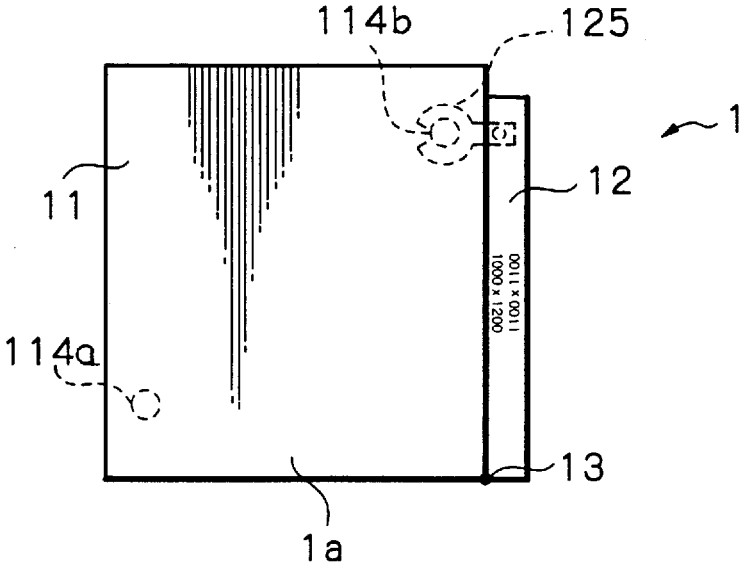

The movable deck 12 is selectively movable to a position shown in FIG. 5A or a position shown in FIG. 5D relative to the pallet body 11. In the position shown in FIG. 5A, one of opposite longer edges (1,000 mm) of the deck 12 contacts one shorter edge (1,000 mm) of the pallet body 11. In this condition, a deck surface 1*a* is sized 1,200 mm×1,000 mm matching with the ISO (International Standards Organization) standard and suitable for transporting packed industrial products for overseas use. In the position shown in FIG. 5D, the other longer edge of the deck 12 contacts one longer edge (1,100 mm) of the pallet body 11, so that the deck surface 1*a* is sized 1,100 mm×1,100 mm matching with JIS (Japanese Industrial Standards). This configuration is suitable for transporting packed industrial articles for domestic use.

Specifically, as shown in FIG. 3, the pallet body 11 has an upper deck 111 and a lower deck 112 interconnected by crossbars 113. The crossbars 113 form spaces M therebetween which are available for a the fork of a forklift. Clamp posts 114 are respectively positioned at two diagonally opposite corners in order to support the upper deck 111 and lower deck 112 and to fix the movable deck 12 in place. The upper deck 111 and lower deck 112 respectively have deck boards 111*a* and 112*a* so combined as to contact each other at their longer sides. As shown in FIG. 4, the deck 12 is rotatably mounted on the outermost deck boards 111*a* and 1112*a* by a hinge 13. The outermost deck boards 111*a* and 112*a* each is formed with a notch for receiving the hinge 13 when the hinge 13 is folded up.

As shown in FIG. 3, the deck 12 has an upper edge board 121 and a lower edge board 122 interconnected by crossbars 123. The deck 12 is rotatably mounted on one corner of the pallet body 11 by the hinge 13. The deck 12 is formed with a guide slot K in the corner by which it is mounted to the pallet body 11 via the hinge 13. A guide pin 133 (see FIG. 4) which will be described below is received in the guide slot K. A metal fitting 124 having a generally L-shaped section is fastened to the deck 12 by screws in order to support the hinge 13. A rubber hook 125 is affixed to the other end of the deck 12 opposite to the mounted end in the longitudinal direction. The hook 125 locks the deck 12 to the pallet body 11 when its bifurcated end 125*a* catches the clamp post 114.

The guide slot K of the metal fitting 124 is also provided with a generally L-shaped configuration. The guide slot K guides the guide pin 133 along the shorter edge of the deck 12 to which the hinge 13 is fastened and the end portion of the longer edge contiguous with the above shorter edge.

The hook 125 is rotatably mounted on the end portions of the upper edge board 121 and lower edge board 121 by a pin P at its end opposite to the bifurcated end 125*a* (rear end). The bifurcated end 125*a* is formed by forming a substantially circular through bore in the end of the hook 125 and notching the outermost part of the wall of the bore. When the bifurcated end 125*a* is pressed against the clamp post 114*a* or 1146, it elastically deforms while extending its notch until it mates with the clamp post 114*a* or 1146.

Contact guides 126 and 127 are respectively arranged on the opposite longer edges of the deck 12. When the shorter side or the longer side of the pallet body 11 and either one of the opposite longer edges of the upper edge board 121 and lower edge board 122 are brought into contact, the corresponding contact guide 126 or 127 promotes smooth contact. Thereafter, the contact guide 126 or 127 allows the top and bottom of the pallet body 11 and the top and bottom o f the deck 12 to remain flush with each other.

Specifically, the contact guides 126 and 127 are respectively made up of plates 126*a* and 126*b* and plates 127*a* and 127*b*. The plates 126*a* and 127*a* and the plates 127*a* and 127*b* are respectively affixed to the lower surface of the upper edge board 121 and the upper surface of the lower edge board 122 in such a manner as to protrude to the outside of the edge boards 121 and 122. The contact guides 126 or 127 are inserted into the space between the upper deck 111 and the lower deck 112, as will be described later. The plates 126*a*, 126*b*, 127*a* and 127*b* each has its outer edge so tapered as to increase the thickness inward.

An indication "1000×1200" is provided on the upper surface of the upper edge board 121 in such a position that the operator looking at the pallet 1 from the deck 12 side can see the indication in the condition shown in FIG. 5A. Another indication "1100×1100" is provided on the upper surface of the upper edge board 121 in such a position that the operator can see it from the deck 12 side when the pallet 11 and deck 12 are held in the condition shown in FIG. 5D.

As shown in FIG. 4, the hinge 13 has metal plates 131 and 132 hinged to each other. The metal plate 131 is fastened to the edges of the notched portion of the outermost deck boards 111*a* and 112*a* by screws. The metal plate 132 is mounted to the metal fitting of the deck 12 such that the guide pin 133 is movable along the guide slot K. The guide pin 133 is made up of a head 133*a*, a shank 133*b*, and a portion 133*c* for preventing the pin 133 from slipping out of the guide slot K. More specifically, the portion 133*c* of the guide pin 133 is retained by the upper and lower edges of the guide slot K so as to prevent the deck 12 from being separated from the hinge 133 The shank 133*b* received in the guide slot K allows the deck 12 to move relative to the hinge 133.

In operation, assume that the operator desires to change the configuration of the deck surface 1*a* of the pallet 1 from one shown in FIG. 5A to one shown in FIG. 5D. First, in the condition shown in FIG. 5A, the operator pulls the end of the deck 12 having the hook 125 outward. As a result, the bifurcated end 125*a* of the hook 125 and therefore its notch is elastically extended until the end 125*a* has been released from the clamp post 114*a*. At the same time, the contact guide 126 is released from the pallet body 11.

Subsequently, as shown in FIG. 5B, the operator rotates the deck 12 away from pallet body 11 by 90 degrees about the hinge 13. Then, as shown in FIG. 5C, the operator shifts the deck 12 until the guide pin 133 of the hinge 13 moves to the other end of the guide slot K.

Thereafter, the operator rotates the hook 125 by 180 degrees about the pin P so as to bring the bifurcated end 125*a* to the opposite side, and then resumes rotation of the deck 12 in the same direction initiated above by substantially 180 degrees about the hinge 13. As a result, the bifurcated end 125*a* of the hook 125 is forced against and engaged with the clamp post 114*b*. At the same time, the contact guide 127 is inserted into the space between the upper deck 111 and the lower deck 112 of the pallet body 11. Consequently, as shown in FIG. 5D, the longer edge of the pallet body 11 and the longer edge of the deck 12 contact each other. The configuration shown in FIG. 5D matches with JIS.

Figure 6:
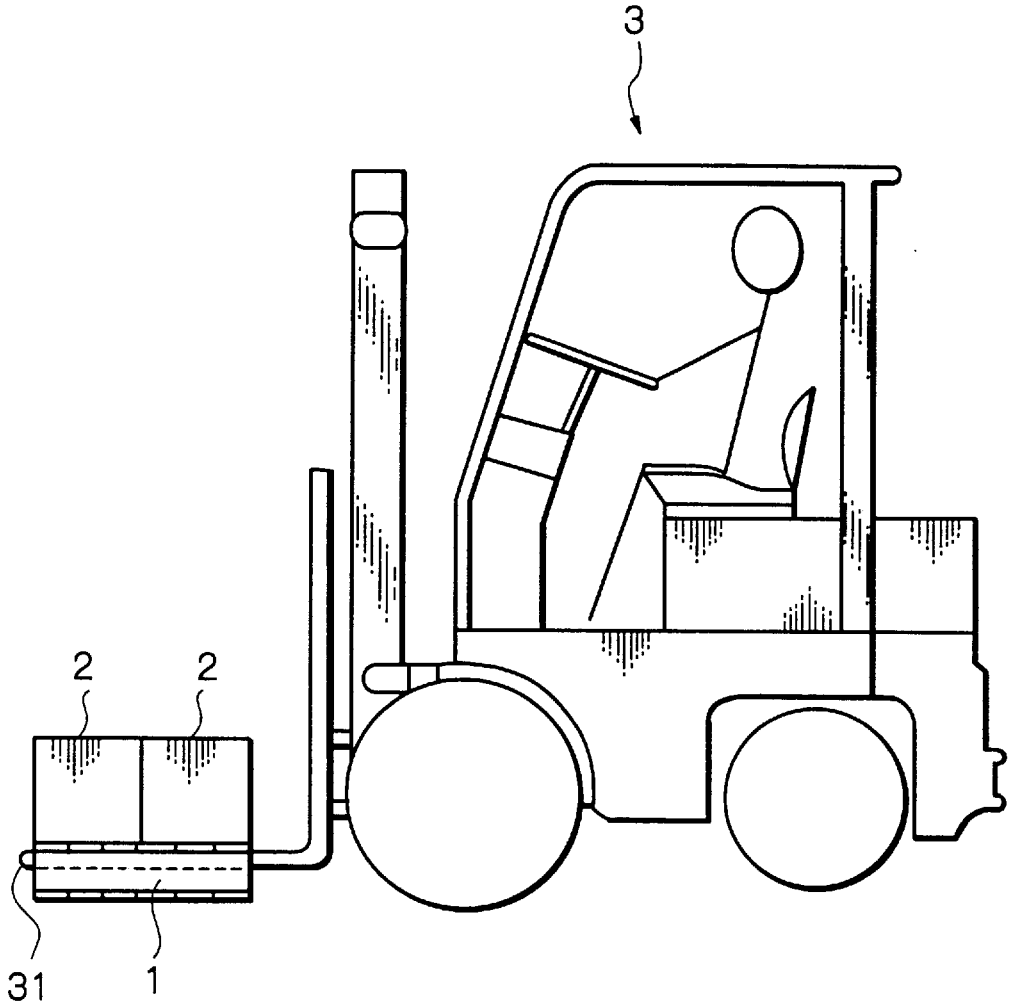
FIG. 6 is a side elevation showing a specific application of the illustrative embodiment.

As shown in FIG. 6, the deck 1*a* of the pallet 1 having the configuration shown in FIG. 5D is loaded with, packed industrial products 2 for domestic use, for example. In this example, the operator of a forklift 3 drives it to insert a fork 31 into the spaces M of the pallet 1 and causes the fork 31 to lift the products.

The procedure described above may be reversed in order to provide the pallet 1 with a contour adequate for the transport of the packed articles 2 for overseas use, i.e., the ISO standards. The contour matching with the ISO standards is shown in FIG. 5A.

As stated above, in the illustrative embodiment, the deck surface 1*a* of the pallet 1 can be provided with a contour matching with JIS or a contour matching with the ISO standards by a simple switching operation. Therefore, the pallet 1 can be readily shared by the products 2 for overseas use and the products 2 for domestic use. The indications "1000×1200" and "1100×1100" provided on the upper edge board 121 allow the operator to easily distinguish the above two different contours of the pallet 1.

In summary, in accordance with the present invention, a second deck is rotatable relative to a first deck by a preselected angle until a first edge of the first deck and a first edge of the second deck contact or until a second edge of the first deck and a second edge of the second deck contact, forming a first contour or a second contour. Therefore, a deck with a desired configuration is achievable with ease.

Various modifications will become possible for those skilled in the art after receiving the teachings of the present disclosure without departing from the scope thereof. For example, while the pallet I is assumed to be made of wood, it may be formed of metal or plastic, if desired. While the hook 125 has been shown and described as being rotatable about the pin P, it may have its opposite ends implemented as the bifurcated ends 125*a* and may be slid. The dimensions of 1,100 mm×1,100 mm and 1,000 mm×100 mm of the pallet body 11 and deck 12, respectively, are only illustrative. Further, nearby deck boards 111*a* or 112*a* may be spaced from each other.

What is claimed is:

1. A duplex pallet comprising:

a pallet body having a deck surface for loading an article in order to allow the article to be conveniently handled;

a movable deck having a deck surface and rotatably connected to said pallet body for allowing the deck surface of said pallet body to be extended by the deck surface of said movable deck in at least two different configurations; and a switching mechanism for allowing said movable deck to be rotated relative to said pallet body between a first configuration where a first side edge of said movable deck and a first side edge of said pallet body contact and a second configuration where a second side edge of said movable deck and a second side edge of said pallet body contact.

2. A duplex pallet as claimed in claim 1, wherein said first side edge of said movable deck and said first side edge of said pallet body have substantially complementary contours in a plan view, and said second side edge of said movable deck and said second side edge of said pallet body have substantially complementary contours in a plan view.

3. A duplex pallet as claimed in claim 1, wherein said movable deck and said pallet body are connected with each other at a contact point, said movable deck being rotatably mounted on said pallet body at said contact point.

4. A duplex pallet as claimed in claim 3, wherein said first side edge and second side edge of said pallet body are adjacent side edges thereof, and said first side edge and said second side edge of said movable deck are opposing side edges thereof.

5. A duplex pallet as claimed in claim 4, wherein said movable deck is movable on said contact point between said first and second side edges of said movable deck.

6. A duplex pallet as claimed in claim 5, wherein said switching mechanism comprises at said contact point a hinge rotatably connecting the movable deck to the pallet body, a guide pin, and a guide slot located on said movable deck between said first and second side edges thereof, wherein the guide pin is slidably disposed in said guide slot to render the movable deck movable on said contact point.

7. A duplex pallet as claimed in claim 4, wherein said contact point is located at the intersection of said first and second side edges of said pallet body.

8. A duplex pallet as claimed in claim 1, further comprising guide means for guiding and aligning the movable deck when being placed into contact with the pallet body in either the first or the second configuration.

9. A duplex pallet as claimed in claim 1, wherein the switching mechanism is configured to rotate the movable deck within the same plane as the pallet body when switching between the first configuration and the second configuration.

10. A duplex pallet comprising:

a pallet body having a substantially square deck surface;

a movable deck having an oblong deck surface rotatably connected to said pallet body for allowing said substantially square surface of said pallet body to be extended by the oblong surface of said movable deck in at least two different configurations; and a switching mechanism for allowing said movable deck to be rotated by 270 degrees about a corner of said pallet body between a first configuration where a first side of said movable deck and a first side of said pallet body contact and a second configuration where a second side of said movable deck opposite to said first side of said second deck and a second side of said pallet body perpendicular to said first side of said pallet body contact.

11. A duplex pallet as claimed in claim 10, further comprising a first locking mechanism for maintaining said first configuration, and a second locking mechanism for maintaining said second configuration.

12. A duplex pallet as claimed in claim 10, wherein a first size and a second size respectively representative of a pallet size particular to said first configuration and a pallet size particular to said second configuration are indicated on a surface of said movable deck, said first size being legible when said pallet body is viewed from the side contacting said movable deck in said the side first configuration, said second size being legible when said pallet body is viewed from contacting said movable deck in said second configuration.

13. A duplex pallet as claimed in claim 10, wherein said switching mechanism connects said movable deck to said pallet body at said corner of the pallet body about which the movable deck is rotated.

14. A duplex pallet as claimed in claim 13, wherein said switching mechanism comprises at said corner a hinge rotatably connecting the movable deck to the pallet body, a guide pin, and a guide slot located on said movable deck between said first and second sides thereof, wherein the guide pin is slidably disposed in said guide slot to render the movable deck laterally translational on said hinge.

* * * * *